US005832994A

United States Patent [19]

Nomura

[11] Patent Number: 5,832,994

[45] Date of Patent: Nov. 10, 1998

[54] HEAT EXCHANGING APPARATUS

[76] Inventor: Shuzo Nomura, Taisei-Haimu 102, 17-6, Nakadai, higashiterao, Turumi-ku, Yokohama-shi, Kanagawa-Ken 230, Japan

[21] Appl. No.: 849,845

[22] PCT Filed: Dec. 14, 1994

[86] PCT No.: PCT/JP94/02090

§ 371 Date: Jun. 13, 1997

§ 102(e) Date: Jun. 13, 1997

[87] PCT Pub. No.: WO96/18859

PCT Pub. Date: Jun. 20, 1996

[51] Int. Cl.[6] ..... F28F 9/02

[52] U.S. Cl. ..... 165/173; 165/145; 165/144; 165/172

[58] Field of Search ..... 165/173, 172, 165/157, 163, 154, 156, 145, 144

[56] References Cited

U.S. PATENT DOCUMENTS

| | | | |
|---|---|---|---|
| 2,237,617 | 4/1941 | Trede | 165/172 |
| 2,566,976 | 9/1951 | Bernstrom | 165/172 |
| 2,973,944 | 3/1961 | Etter | 165/145 |
| 3,053,512 | 9/1962 | Soudan et al. | 165/145 |
| 3,746,084 | 7/1973 | Ostbo | 165/163 |
| 3,854,530 | 12/1974 | Jouet et al. | 165/163 |
| 4,143,816 | 3/1979 | Skadeland | 165/163 X |
| 4,287,724 | 9/1981 | Clark | 165/163 X |
| 4,516,630 | 5/1985 | Yamaguchi | 165/172 X |
| 5,099,915 | 3/1992 | Van Dyke | 165/156 |
| 5,165,472 | 11/1992 | Cloutier | 165/163 X |
| 5,295,532 | 3/1994 | Hughes | 165/173 X |
| 5,315,845 | 5/1994 | Lee | 165/172 X |
| 5,423,378 | 6/1995 | Dillenbeck et al. | 165/163 X |
| 5,437,844 | 8/1995 | Bonner | 165/172 X |

FOREIGN PATENT DOCUMENTS

| | | | |
|---|---|---|---|
| 95096 | 7/1923 | Austria | 165/157 |
| 655275 | 1/1938 | Germany | 165/172 |
| 13-7838 | 6/1938 | Japan . | |
| 36-24992 | 9/1961 | Japan . | |
| 2508247 | 5/1950 | United Kingdom | 165/172 |

OTHER PUBLICATIONS

Microfilm of the specification and drawings annexed to the written application of Japanese Utility Model Application No. 153214/1987 (Laid–open No. 61566/1989) (Toyo Radiator Co., Ltd.), Apr. 19, 1989, Fig. 5.

*Primary Examiner*—Ira S. Lazarus
*Assistant Examiner*—Christopher Atkinson

[57] ABSTRACT

A heat exchanging apparatus is capable of efficiently heat exchanging a large quantity of fluids and whose construction can be simplified. A heat exchanging flowpassage (10) is arranged internally of a heat exchanging vessel to and from which a liquefied nitrogen as a heat transfer medium is supplied and discharged. The heat exchanging flowpassage (10) has annular tubes (18) arranged in plural rows, the adjoining annular tubes (18) are communicated at plural locations by communicating tubes (19) at positions deviated in a peripheral direction, and tanks (20) and (21) are communicated with a supply port side and a discharge port side. A supply tube (11) is communicated with the tank (20), and a discharge pipe (12) is communicated with the tank (21). Since the positions of the inlet and the outlet in each annular tube (18) are deviated in a peripheral direction, fluids are caused to flow in a turbulent state while repetitively impinging upon wall surfaces of the heat exchanging flowpassage (10) so as to be much affected by a temperature of the wall surfaces.

6 Claims, 6 Drawing Sheets

Fig. 6

| MARKS IN THE GRAPH | DRY AIR FLOW RATE (ℓ/MIN) | MINIMUM TEMPERATURE OF RELEASE GAS (°C) | INLET PRESSURE (kg/cm$^2$) | OUTLET PRESSURE (kg/cm$^2$) | CONSUMPTION $LN_2$ (kg/MIN) | HEAT EXCHANGE EFFICIENCY | LIQUEFYING RATE (%) |
|---|---|---|---|---|---|---|---|
| ○ ---- ○ | 390 | -169 | 0.22 - 0.25 | 0.13 - 0.15 | 0.77 | 0.585 | ---- |
| △ ---- △ | 590 | -185 | 0.43 - 0.45 | 0.25 - 0.26 | 1.0 | 0.93 | ---- |
| □ ---- □ | 780 | -192 | 0.65 - 0.67 | 0.38 | 1.2 | 1.051 | 22.7 |
| ● ---- ● | 980 | -192 | 0.90 - 0.93 | 0.51 - 0.55 | 1.4 | 1.224 | 27.6 |
| ▲ ---- ▲ | 1180 | -192 | 1.14 - 1.29 | 0.66 - 0.69 | 1.4 | 1.429 | 20.8 |
| ■ ---- ■ | 1370 | -192 | 1.24 - 1.30 | 0.69 - 0.75 | 1.5 | 1.694 | 24.7 |

HEAT EXCHANGING APPARATUS

TECHNICAL FIELD

The present invention relates to an improvement in a heat exchanging apparatus.

BACKGROUND ART

In the past, nitrogen, oxygen, argon and other gases are stored in a superlow temperature storage tank in a liquefied state. When in use, the stored liquefied gas is fed to an evaporator where the gas is vaporized and gasified at an atmospheric temperature or in hot water.

However, in the past, cooling heat of the liquefied gas is not effectively utilized but is wasted. In order to effectively utilize the cooling heat to cool gases such as air, nitrogen, oxygen, argon, hydrogen, etc., or fluids such as a mixture of liquid and gas, etc., it is contemplated that a heat exchanger is intervened between a superlow temperature storage tank and an evaporator.

The conventional heat exchangers heretofore used have various configurations such as a coil type, a double tube type, a water injection type, a bushing type, a finned multitube type, etc.

However, the conventional heat exchangers as described above are poor in cooling effect because the fluid to be cooled flows through the tube regularly and is less affected by a temperature from wall surfaces of the tube. So, when being restricted as in an expansion valve at downstream in order to enhance the cooling effect, a large quantity of fluids cannot be cooled. Accordingly, there was a problem in that the conventional heat exchangers cannot be utilized in the case where a large quantity of fluids at a constant temperature need be secured.

The present invention is to overcome the problem as noted above with respect to prior art. It is an object of the present invention to provide a heat exchanging apparatus which can heat-exchange a large quantity of fluids efficiently without restricting the fluids, and accordingly, a large quantity of heat exchanging fluids at a constant pressure and at a constant temperature can be obtained and conveniently utilized, and in which the construction thereof can be simplified to thereby remove troubles and to lower the cost.

DISCLOSURE OF THE INVENTION

Technical means of the present invention for achieving the aforementioned object comprises a heat exchanging vessel to and from which a heat transfer medium is supplied and discharged; a heat exchanging flowpassage having a plurality of peripheral flowpassages arranged in parallel within said heat exchanging vessel and communicated in a peripheral direction and communicating flowpassages in which a plurality of locations between said peripheral flowpassages are communicated so that positions of an inlet and an outlet in each peripheral flowpassage are deviated in a peripheral direction; and a fluid supply path and a fluid discharge path inserted into said heat exchanging vessel and communicated with said heat exchanging flowpassage. It is to be noted that the flowpassage termed herein means an article such as a tube through which fluid flows. The same is true for claims.

Preferably, in the aforementioned technical means, the heat exchanging flowpassage has tanks on the supply port side and on the discharge port side, and the supply path and the discharge path are communicated with the tanks.

According to the present invention constructed as described above, when the heat exchanging vessel is filled with the heat transfer medium and the fluid for heat exchange is supplied from the supply path to the heat exchanging flowpassage, the thus supplied fluid in the heat exchanging flowpassage flows into the plurality of the peripheral flowpassages arranged in parallel and the communicating flowpassages for communicating them. However, since the positions of the inlet and the outlet in the peripheral flowpassages are deviated in a peripheral direction, the fluid flows as a turbulence while repetitively impinging upon the wall surfaces of the heat exchanging flowpassages, during which the fluid can carry away heat of the heat transfer medium or heat of the fluid can be carried away by the heat transfer medium, and the fluid after heat exchange can be discharged outside the heat exchanging vessel from the discharge path. In this manner, the fluid is caused to flow in a turbulent state while repetitively impinging upon the wall surfaces of the heat exchanging flowpassages whereby the fluid is much affected by the temperature of the wall surfaces, and the fluids fed from the communicating flowpassages in the peripheral flowpassages are placed in the same condition and dispersed, thus enabling the effective heat exchange of a large quantity of fluids without restricting the fluids. Further, since the heat exchanging flowpassages can be configured by connection of flowpassages, the construction can be simplified.

BRIEF DESCRIPTION OF DRAWINGS

FIG. 6 is a table indicating the values every flow rate of dry air shown in the graph of FIG. 5.

Figure 1:
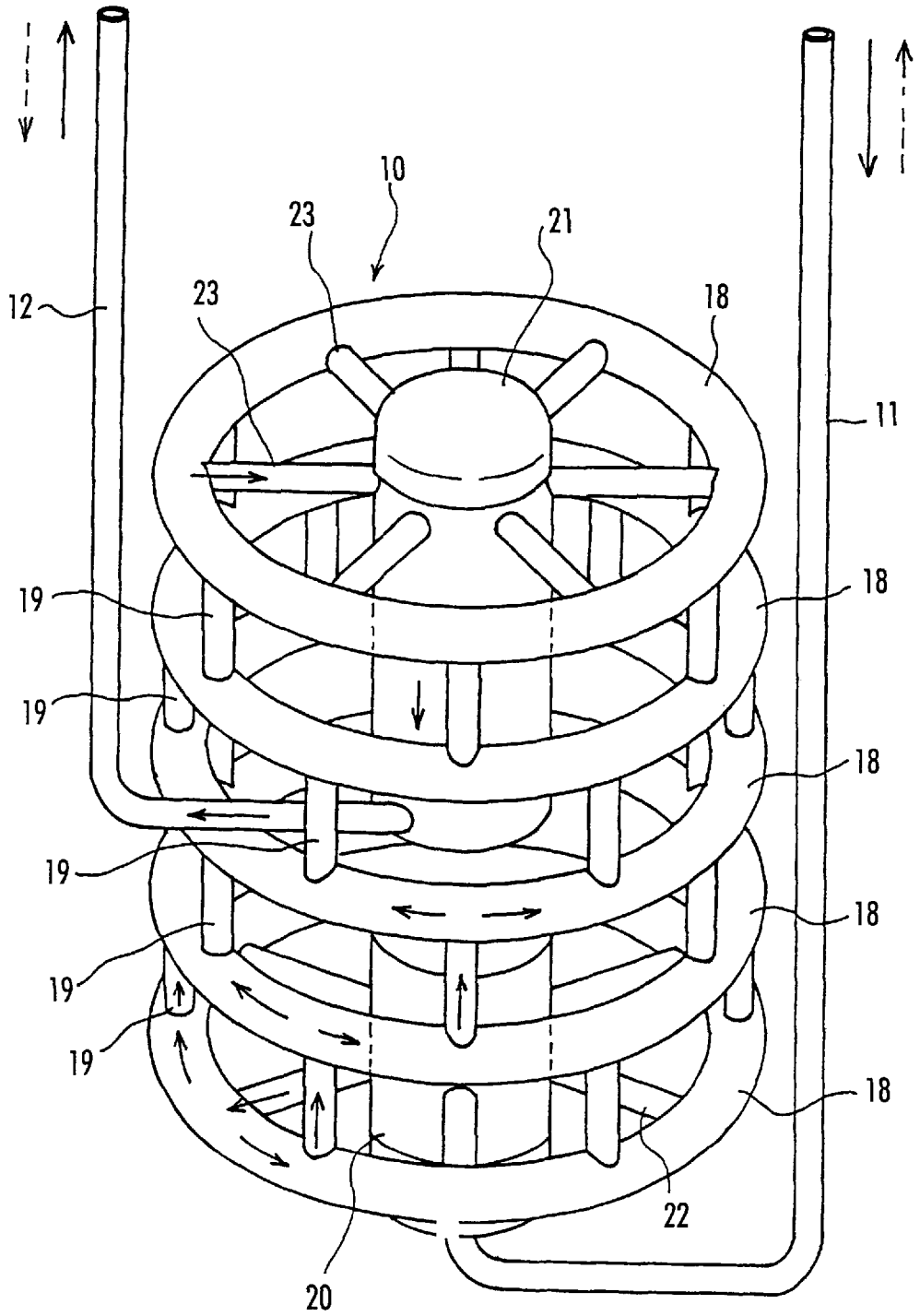
FIG. 1 is a perspective view of main parts showing a heat exchanging apparatus according to one embodiment of the present invention.

The description of reference numerals used in the drawings is as follows:

2 Heat exchanging apparatus
3 Heat exchanging vessel
10 Heat exchanging flowpassage
11 Supply tube
12 Discharge tube
18 Annular tube (peripheral flowpassage)
19 Communicating tube
20 Tank on the supply port side
21 Tank on the discharge port side
100 Compressor
101 Flowmeter
102 Weight meter

103 Synflex tube (½ inch)

104 Liquid nitrogen (−196° C.)

105 Heat exchanger

106 Digital pressure gauge

107 Digital thermometer

108 Gas holder

109 Cooled dry air

BEST MODE FOR CARRYING OUT THE INVENTION

One embodiment of the present invention will be described hereinafter with reference to the drawings.

Figure 2:
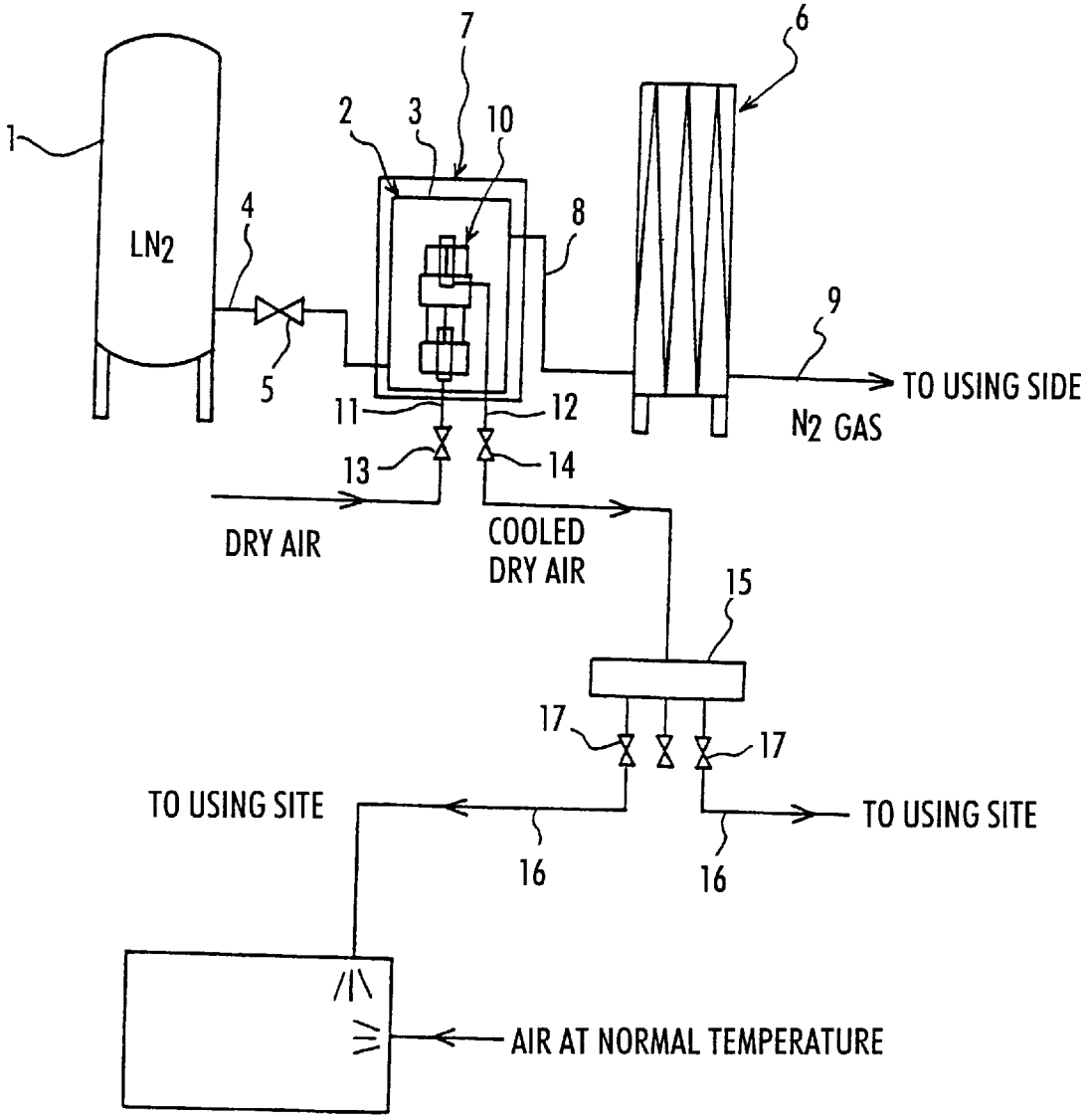
FIG. 2 is a schematic systematic view showing a using example in which the heat exchanging apparatus is incorporated between a superlow temperature storage tank for liquefied nitrogen and an evaporator.

FIG. 1 is a perspective view of main parts showing a heat exchanging apparatus according to one embodiment of the present invention; and FIG. 2 is schematic systematic view showing a using example in which the heat exchanging apparatus is incorporated between a superlow temperature storage tank for liquefied nitrogen and an evaporator.

As shown in FIG. 2, a superlow temperature storage tank 1 can store liquefied nitrogen at −196° C. The superlow temperatue storage tank 1 has its bottom communicated with a bottom of a heat exchanging vessel 3 of a heat exchanging apparatus 2 according to the present invention by means of a tube 4, and a valve 5 is provided in the middle of the tube 4. An upper portion of the heat exchanging vessel 3 is communicated with an inlet of an evaporator 6 by means of a tube 8, and a supply tube 9 is communicatd with an outlet of the evaporator 6. A heat exchanging flowpassage 10 is arranged within the heat exchanging vessel 3 of the heat exchanging apparatus 2 as will be described later, and a supply tube 11 and a discharge tube 12 for dry air inserted into the heat exchanging vessel 3 are communicated with the heat exchanging flowpassage 10. Valves 13 and 14 are provided in the middle of the supply tube 11 and the discharge tube 12, respectively, the discharge tube 12 being communicated with a tank 15. A plurality of supply tubes 16 are communicated with the tank 15, and a valve 17 is provided in the middle of each of the supply tubes 16.

The heat exchanging flowpassage 10 is composed of annular tubes 18 communicated in a circumferential direction which constitute peripheral flowpassages, communicating tubes 19 which constitute communicating flowpassages, a tank 20 on the supply port side, a tank 21 on the discharge port side, and the like, as shown in FIG. 1. Plural rows (5 rows in the illustrated embodiment) of the annular tubes 18 are arranged in a parallel state so as to have a desired spacing in a vertical direction around a vertical axis. The annular tubes 18 adjacent to each other are communicated at plural locations by the communicating tubes 19 in a vertical direction. The communicating tubes 19 in each of upper and lower rows are arranged substantially at equal intervals while being alternately deviated in a peripheral direction to each other so that the positions of an inlet and an outlet at the annular tube 18 in each row are alternately deviated in a peripheral direction, the inlet and the outlet being set so that the inlet and the outlet are not opposed on a straight line. The tank 20 on the supply port side and the tank 21 on the discharge port side are arranged on the lower inside and on the upper inside of the plural rows of the annular tubes 18. The tank 20 on the supply port side is communicated in its intermediate portion with the lowermost annular tube 18 by means of communicating tubes 22 arranged radially, and the tank 21 on the discharge port side is communicated in its upper end portion with the uppermost annular tube 18 by means of communicating tubes 23 arranged radially. The supply tube 11 is communicated with the bottom of the tank 20 on the supply port side, and the discharge tube 12 is communicated with the bottom of the tank 21 on the discharge port side.

The heat exchanging vessel 3, the annular tubes 18 constituting the said heat exchanging flowpassage 10, the communicating tubes 19, the tanks 20 and 21, the communicating tubes 22 and 23, the supply tube 11, and the discharge tube 12 are formed of materials which withstand a low temperature, for example, such as stainless steel and copper.

The operation of the aforementioned constitution will be explained hereinafter.

A liquefied nitrogen, which is a heat transfer medium, is supplied into and filled in the heat exchanging vessel 3 of the heat exchanging apparatus 2 by the tube 4 from the superlow temperature storage tank 1. The vessel 3 is applied with a heat insulating material 7 to prevent it from being frozen. In this state, dry air to be cooled by heat exchange is supplied to the tank 20 on the supply port side of the heat exchanging flowpassage 10 immersed with the liquefied nitrogen from the supply tube 11. The dry air supplied into the tank 20 flows into the lowermost annular tube 18 passing through the communicating tubes 22, and flows from the lowermost annular tube 18 into its upper level annular tube 18 passing through the communicating tubes 19. Thereafter, the dry air sequentially flows into the upper level annular tube 18 passing through the communicating tubes 19, and flows from the uppermost annular tube 18 into the tank 21 on the discharge port side passing through the communicating tubes 23. In the tubes 18, 19, 22 and 23 and the tanks 20 and 21, cooling heat of the liquefied nitrogen, which is a refrigerant, is carried away from the wall surfaces thereof (that is, heat of dry air is carried away) to cool them while the dry air is flowing in a manner as described above. At this time, when the dry air flows into the lowermost annular tube 18 from the communicating tubes 22, it impinges upon the wall surface of the annular tube 18. Since the positions of the inlets in each row of annular tubes 18 are alternately deviated in a peripheral direction as described above and the inlet and the outlet are set so that they are not opposed, when the dry air flows into the annular tubes 18 from the communicating tubes 19, the dry air impinges upon the wall surfaces of the annular tubes 18 and is divided into left and right portions, and further impinges upon the dry air which likewise flows from the adjoining communicating tube 19 to impinge upon the wall surface of the annular tube 18, which dry air sequentially flows as a turbulence into the uppermost annular tube 18. In this way, the dry air repetitively impinges upon the wall surface and flows in a turbulent state which is much affected by the temperature of the wall surface, and dry air fed from the communicating tubes 19 on each line in the annular tubes 18 is placed in the same condition so that dry air does not flow only in a fixed line but is dispersed. Therefore, it is possible to efficiently carry away cooling heat of the liquefied nitrogen (that is, heat of dry air is carried away).

The same is true in the case where a part of the supply tube 11 is changed for that of the discharge tube 12 so that the supply tube 11 functions reversely to the discharge tube or the discharge tube 12 functions reversely to the supply tube.

The dry air cooled by the heat exchange as described above flows from the tank 21 into the tank 15 by the discharge tube 12, and can be distributed into using sites as desired by the plurality of the supply tubes 16. At each using site, the dry air can be mixed with air at normal temperature to adjust it to a suitable temperature for use. On the other hand, the liquefied nitrogen from which cooling heat was carried away by the heat exchange is introduced into the evaporator 6 by the tube 8 and vaporized at an atmospheric temperature or in hot water into nitrogen gas. The thus obtained nitrogen gas can be supplied to the using site as desired by the supply tube 9.

In the prior art, liquefied nitrogen is directly supplied to the evaporator 6. In the embodiment of the present invention, however, after being used for heat exchange by the heat exchanging apparatus 2, liquefied nitrogen is supplied to the evaporator 6, by which the temperature of liquefied nitrogen rises. Therefore, the evaporating efficiency obtained by the evaporator 6 can be improved.

The results of experiments on the cooling efficiency of dry air according to the embodiment of the present invention are given below. The experiments have been conducted under the following conditions.

| Measured gas | | |
|---|---|---|
| dry air | pressure | 6.8 kg/cm$^2$ |
| | dew point | less than −80° C. |
| | temperature | 9° C. |

| Refrigerant gas | | |
|---|---|---|
| liquid nitrogen | temperature | −196° C. |
| | evaporation temperature | −188° C. |
| | natural evaporation amount | 0.05 kg/min |

Figure 3:
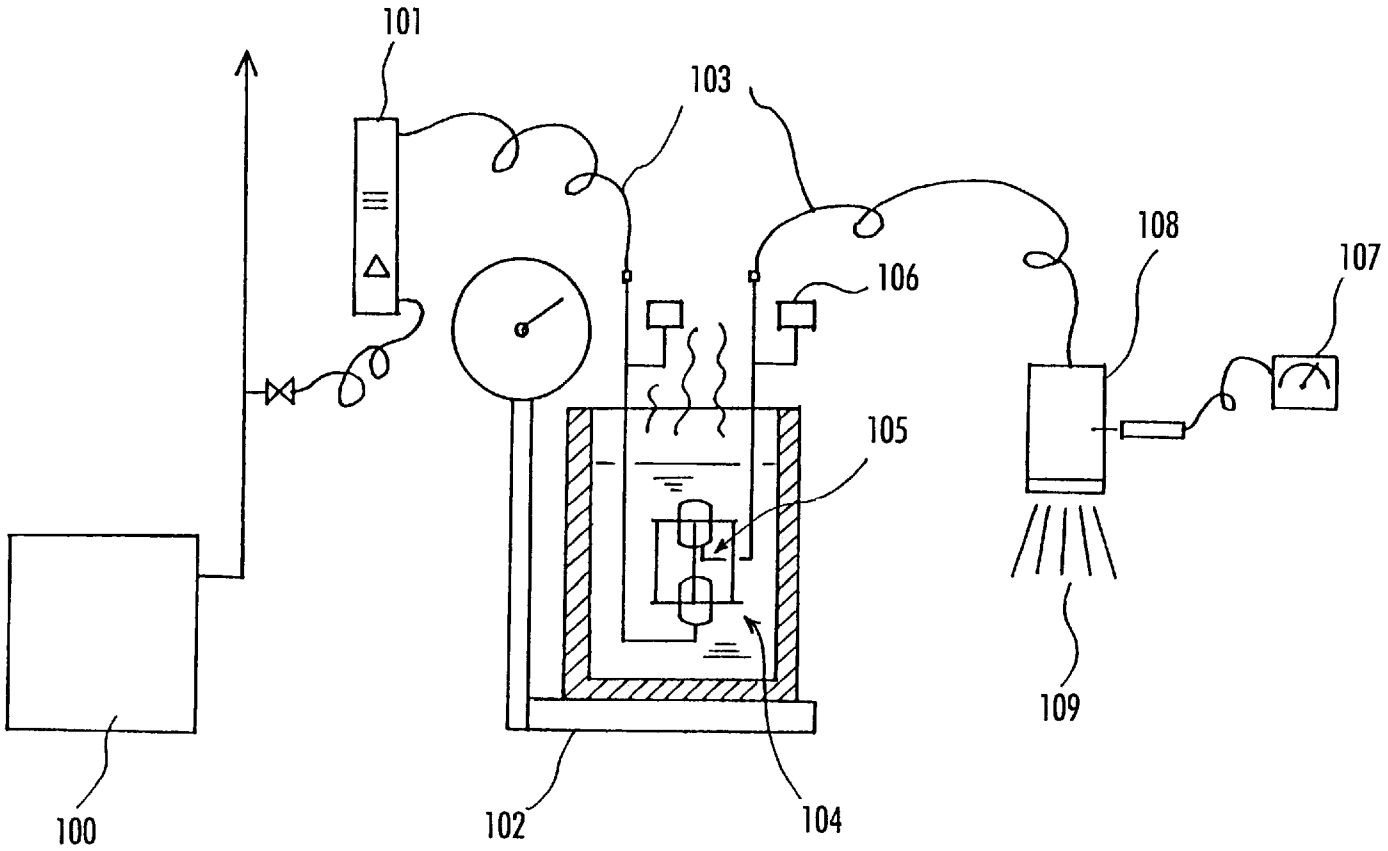
FIG. 3 is a system constitutional view of an apparatus used for cooling experiments of dry air using the heat exchanging apparatus according to one embodiment of the present invention.

The system of the apparatus used for experiments is shown in FIG. 3.

The method of the present experiment may be summarized as follows:

1. Dry air for measurement was taken off through a ½ inch tube by a takeoff valve in the factory and supplied.
2. For obtaining the relationship between flow rate and pressure, a float type flowmeter was mounted at an inlet of a heat exchanger, and digital type pressure gauges were mounted at an inlet and an outlet.
3. All the heat exchanger were manufactured of SUS.
4. The heat exchanger was put into an SUS container applied with simple insulation and the container was internally filled with liquid nitrogen from an ELF. The container is of an open type with a lid merely placed.
5. For measuring the weight of the vaporized liquid nitrogen, the entire SUS container was placed on the weight meter to measure the weight from a change of graduations. The reduced value was measured every 30 seconds, and the mean value per minute of the same flow rate was obtained.
6. Dry air cooled by the heat exchanger was put into a gas holder by a ½ inch Synflex tube to measure a change of temperature by a digital type thermometer mounted on the holder.

Figure 4:
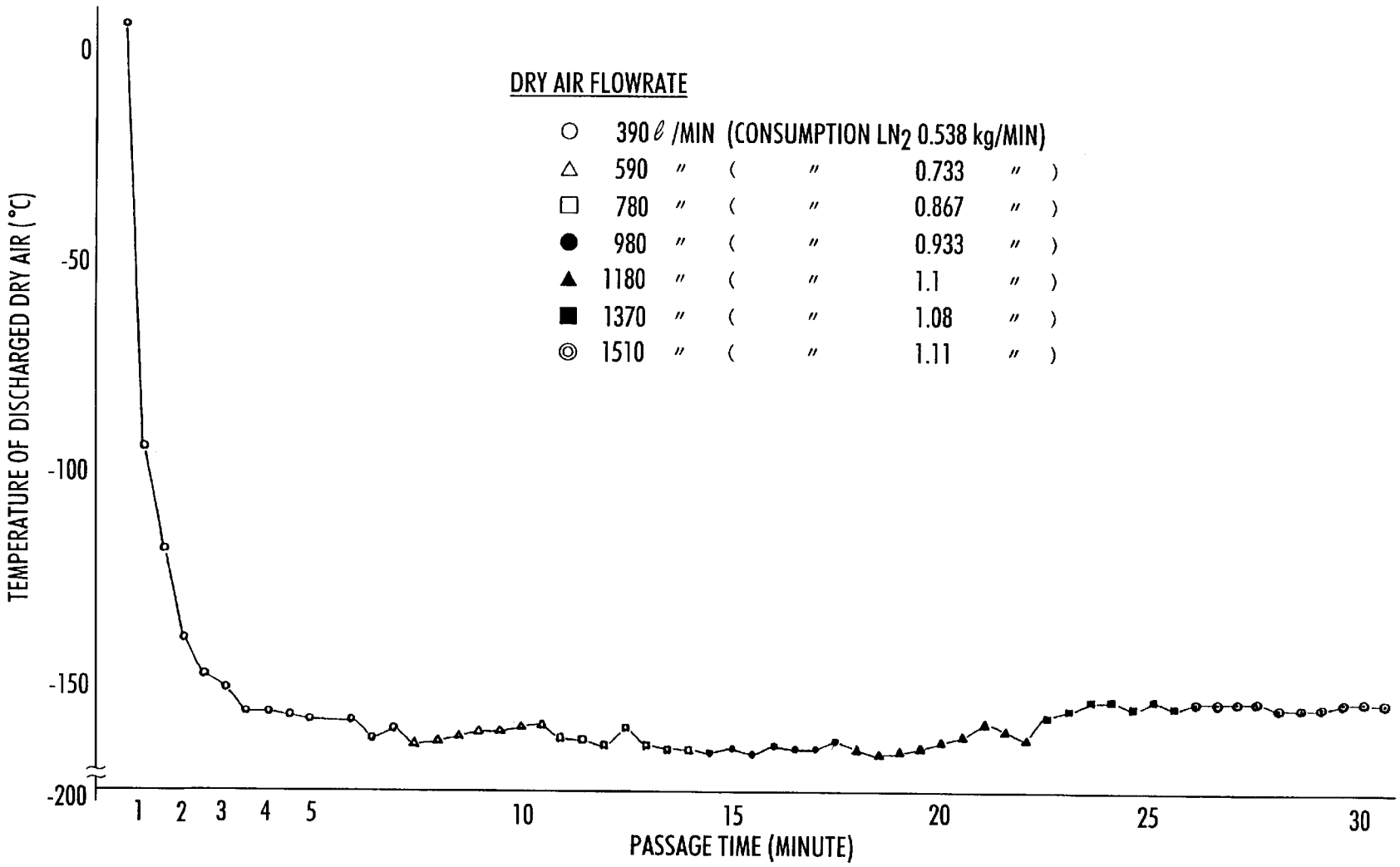
FIG. 4 is a graph showing the results of cooling experiments of dry air using a heat exchanging apparatus (a 2-stage ring type) according to one embodiment of the present invention (an axis of abscissa: passage time; an axis of ordinate: temperature of dry air to be discharged).
Figure 5:
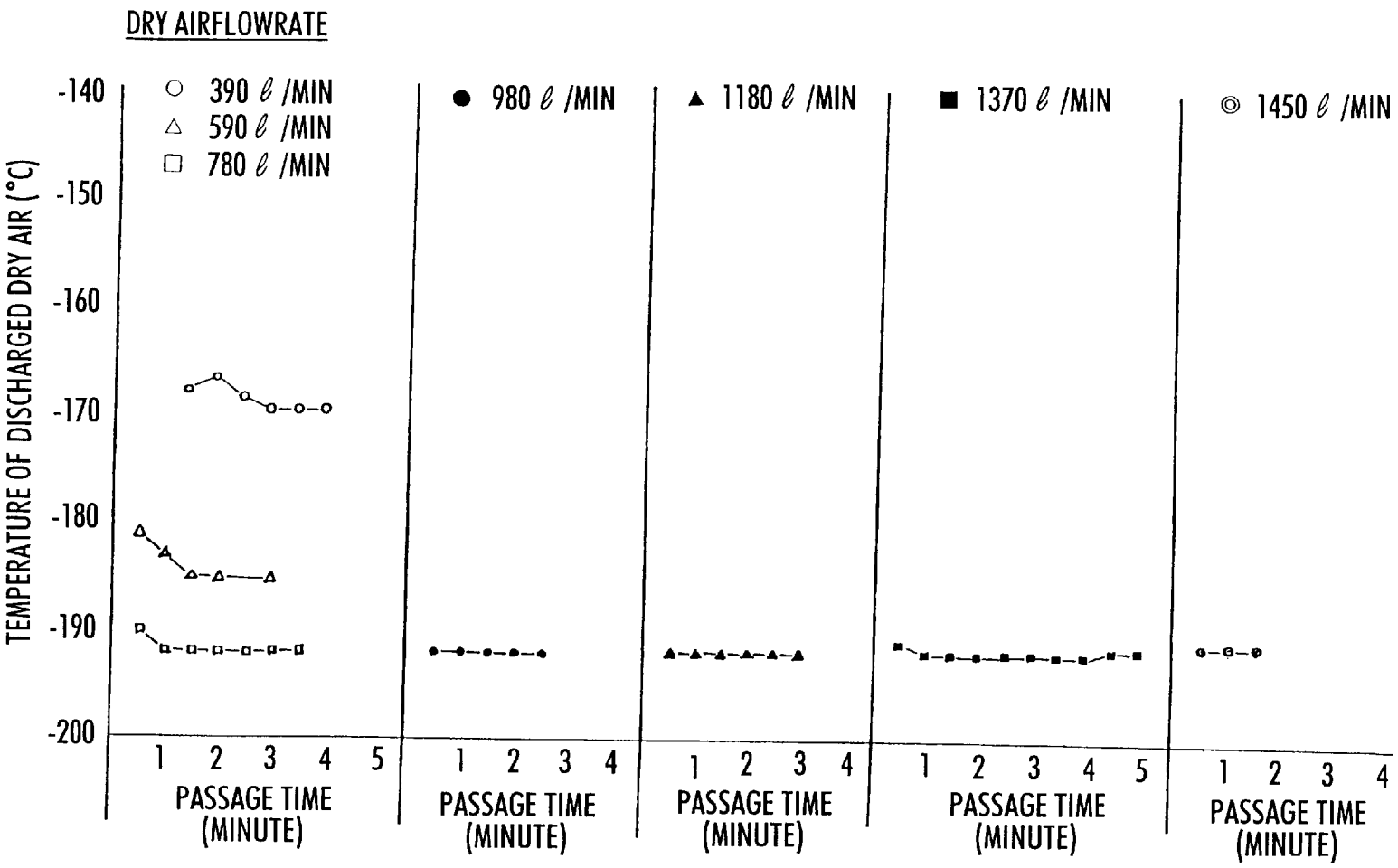
FIG. 5 is a graph showing the results of cooling experiments of dry air using a heat exchanging apparatus (a 5-stage ring type) according to one embodiment of the present invention (an axis of abscissa: passage time; an axis of ordinate: temperature of dry air to be discharged).

The results of experiments are as shown in FIGS. 4 and 5.

FIG. 4 is a graph indicating temperatures of cooled dry air discharged from the heat exchanger with respect to the passage time from the start of supplying dry air in the case where a 2-stage ring type heat exchanger (in FIG. 1, two uppermost and lowermost annular tubes 18 are used, between which is connected the communicating tubes 19) was used.

The results of experiments may be summarized as follows:

1. The more flow rate of dry air, the heat exchanging efficiency for cooling is enhanced.
2. In the case where the flow rate of dry air is in the constant condition, an outlet pressure relative to an inlet pressure is substantially constant, and a variation of pressure rarely occurred.
3. A minimal temperature of dry air discharged reached to −162° C., a cooling gas at a constant temperature relative to a constant flow rate was generated, and no variation of temperature occurred.
4. In the 2-stage ring, only cooling gas was discharged, and no liquefying phenomenon was found.
5. In 2 to 3 minutes after supply of dry air, a temperature reaches to approximately −160° C.

FIG. 5 is a graph indicating temperatures of cooled dry air discharged from the heat exchanger with respect to the passage time from the start of supplying dry air in the case where a 5-stage ring type heat exchanger was used.

As described above, according to the aforementioned embodiment, since a large quantity of dry air can be heat exchanged efficiently without restricting dry air, it is possible to obtain a large quantity of dry air cooled to a constant temperature. Further, since dry air is once stayed in the tank 20 on the supply port side from the supply tube 11, dry air can be supplied at constant pressure and at constant flow rate to the communicating tubes 19 in each line. Further, since dry air after cooled to a constant temperature from the communicating tubes 19 in each line is once stayed in the tank 21 on the discharge port side, it is possible to supply the dry air after cooled to the using site at constant pressure and at constant flow rate. It is possible to simply increase the quantity of dry air to be cooled by increasing a diameter, an area and a length of the annular tube 18, the communicating tube 19 or the like and a volume of the tanks 20 and 21.

While in the aforementioned embodiment, the tubes 18, 19, 11 and 12 having a circular section have been used for the peripheral flowpassage, the communicating flowpassage, the supply path, the discharge path or the like, it is to be noted that a square and an oval in section may be also used.

Further, the peripheral flowpassage is not limited to an annular shape but a square and an oval can be used. The communicating tubes 19 are not always arranged at equal intervals. The annular tubes may be different in diameter. The communicating tubes may not connect adjoining annular tubes, but for example, they may alternately connect annular tubes. Of course, as the heat transfer medium, there can be used, other than liquefied nitrogen, refrigerants such as liquefied oxygen, liquefied argon, LNG, etc. For the purpose of raising a temperature, a heating medium can be used. As a fluid subjected to heat exchange, there can be used, other than dry air, gases such as nitrogen, oxygen, hydrogen, argon, natural gas, etc., and a mixture of liquid and gas. Further, alternatively, a plurality of rows of annular tubes 18 as peripheral flowpassages may be arranged in parallel in a lateral direction around a horizontal axis. Besides, the present invention can be variously changed in design within a scope not departing from the basic technical idea thereof.

As described above, according to the present invention, when the heat exchanging vessel is filled with the heat transfer medium and the fluid for heat exchange is supplied from the supply path to the heat exchanging flowpassage, the thus supplied fluid in the heat exchanging flowpassage flows into the plurality of the peripheral flowpassages arranged in parallel and the communicating flowpassages for communicating them. However, since the positions of the inlet and the outlet in the peripheral flowpassages are deviated in a peripheral direction, the fluid flows as a turbulence while repetitively impinging upon the wall surfaces of the heat exchanging flowpassages, during which the fluid can carry away heat of the heat transfer medium or heat of the fluid can be carried away by the heat transfer medium, and the fluid after heat exchange can be discharged outside the heat exchanging vessel from the discharge path. In this manner, the fluid is caused to flow in a turbulent state while repetitively impinging upon the wall surfaces of the heat exchanging flowpassages whereby the fluid is much affected by the temperature of the wall surfaces. Further, the temperature is lowered due to the turbulent expansion of the fluid, and the fluids fed from the communicating flowpassages in the peripheral flowpassages are placed in the same condition and dispersed without flowing in a specified communication flow passege, thus enabling the effective heatexchange of a large quantity of fluids without restricting the fluids. Accordingly, a large quantity of heat exchanging fluids at a constant temperature can be obtained and conveniently utilized. Further, since the heat exchanging flowpassages can be configured by connection of flowpassages, the construction can be simplified. Accordingly, troubles can be removed, and the cost can be lowered.

Moreover, the heat exchanging flowpassage has tanks on the supply port side and on the discharge port side, respectively, and the supply path and the discharge path are communicated with the respective tanks whereby the fluid is once stayed in the tank on the supply port side from the supply path and the fluid can be supplied to the communicating flowpassages in each line at constant pressure and at constant flow rate, and the fluid heat exchanged to a constant temperature is once stayed in the tank on the exhaust port side from the communicating flowpassages in each line and can be supplied to the using site at constant pressure and at constant flow rate, thus enabling further stable utilization.

INDUSTRIAL APPLICABILITY

As described above, the heat exchanging apparatus according to the present invention is useful as a heat exchanging apparatus for air cooling and as a heat exchanging apparatus for air conditioning having a large capacity, and is suitable for use with a heat exchanging apparatus particularly for a freezing warehouse or the like which is large in scale and requires a low temperature.

I claim:

1. A heat exchanging tube passage structure for a heat exchanging apparatus comprising:

a plurality of spaced annular tubes arranged in parallel with one another;

a plurality of ports formed about the periphery of each of said annual tubes; and a plurality of communicating tubes for communicating the ports formed in one of said annular tubes with the ports formed in an adjacent annular tube, the communicating tubes which extend between two adjacent annular tubes being offset with respect to the communicating tubes which interconnect another adjacent pair of annular tubes.

2. A heat exchanging tube passage structure as set forth in claim 1, further comprising first and second tanks which are disposed in a space defined within said plurality of annular tubes, said first tank being communicated with a supply tube and with a first of said plurality of annular tubes via a first set of radially extending communicating tubes, said second tank being communicated with a discharge tube and with a second of said plurality of annular tubes via a second set of radially extending communicating tubes, the second annular tube being arranged to be distal from the first annular tube.

3. A heat exchange tube passage structure as set forth in claim 1, wherein the plurality of annular tubes are arranged concentrically with respect to one another and wherein the communicating tubes which interconnect adjacent annular tubes are essentially parallel with an axis about which the plurality of annular tubes are arranged.

4. A heat exchanging tube passage structure as set forth in claim 2, wherein said first and second tanks are cylindrical, and wherein the supply tube communicates with a lower end of said first tank, and wherein the discharge tube communicates with a lower end of said second tank.

5. A heat exchanging tube structure comprising:

a first plurality of radially extending communicating tubes which extend radially outward from a first collection point;

a second plurality of radially extending communicating tubes which extend radially outward from a second collection point;

a first annular tube which fluidly communicates with each of the first plurality of radially extending communicating tubes;

a second annular tube which fluidly communicates with each of the second plurality of radially extending communicating tubes;

a third annular tube which is disposed between said first and second annular tubes;

a first plurality of parallel communicating tubes fluidly interconnecting said first and third annular tubes; and a second plurality of parallel communicating tubes fluidly interconnecting said second and third annular tubes, said second plurality of parallel communicating tubes being arranged to communicate with the third annular tube at locations which are offset from the locations at which the first set of parallel communicating tubes communicate with said third annular tube, so that fluid flow through one of said first and second plurality of parallel communicating tubes must change direction and flow a portion of the third annular tube before entering the other of the first and second plurality of communicating tubes.

6. A heat exchanging tube structure as set forth in claim 5, wherein the first and second collection points comprise first and second essentially cylindrical tanks which are aligned with one another along an axis, and wherein the first tank fluidly communicates with a supply tube and the second tank fluidly communicates with a discharge tube.

* * * * *